United States Patent [19]

Wagner et al.

[11] Patent Number: 4,890,547

[45] Date of Patent: Jan. 2, 1990

[54] VENTILATOR SCROLL ARRANGEMENT

[75] Inventors: Todd M. Wagner, Verona; Hardin T. James, Jr., Mt. Horeb; Thomas G. Ayers, Mt. Horeb; Dennis B. Breese, Mt. Horeb; Gordon A. Durand, Verona, all of Wis.

[73] Assignee: Carnes Company, Inc., Verona, Wis.

[21] Appl. No.: 303,732

[22] Filed: Jan. 27, 1989

[51] Int. Cl.[4] ..... F24F 7/06

[52] U.S. Cl. ..... 98/42.13

[58] Field of Search ..... 98/42.02, 42.07, 42.08, 98/42.11, 42.13

[56] References Cited

U.S. PATENT DOCUMENTS

| | | | |
|---|---|---|---|
| 126,639 | 5/1872 | Leffel . | |
| 223,300 | 1/1880 | Smethells . | |
| 594,206 | 11/1897 | Jeffreys . | |
| 2,439,124 | 4/1948 | Bergstrom . | |
| 2,582,902 | 1/1952 | Gohl | 98/42.13 |
| 2,666,378 | 1/1954 | Ammerman | 98/42.13 |
| 2,847,156 | 8/1958 | Bleier . | |
| 2,912,916 | 11/1959 | Mohrman . | |
| 2,982,198 | 5/1961 | Mohrman | 98/42.13 |
| 3,123,284 | 3/1964 | Greenawalt . | |
| 3,149,553 | 9/1964 | Solzman . | |
| 3,349,998 | 10/1967 | Stirling | 98/42.13 X |
| 3,482,767 | 12/1969 | Reinkoester, Jr. . | |
| 3,601,184 | 8/1971 | Hauville | 165/125 |
| 4,768,424 | 9/1988 | Frenkler et al. | 98/42.11 X |

*Primary Examiner*—Harold Joyce

*Attorney, Agent, or Firm*—Michael, Best & Friedrich

[57] ABSTRACT

A rooftop ventilator includes a fan arranged for rotation about a generally vertical axis. The fan is on a rooftop curb through which air is drawn by the fan from the building interior. A housing extends over the fan and the fan terminates above and spaced from a curb to define a discharge opening for air drawn through the curb. A scroll arrangement is located above the curb and arranged around the periphery of the fan to receive air discharged by the fan and direct it toward the discharge opening. The scroll arrangement is made up of a plurality of scroll elements equally spaced around the periphery of the fan. Each of the scroll elements includes a first elongated element having one end generally adjacent the fan periphery and extending away from the fan periphery; a second elongated element, connected to the first elements to provide a generally continuous extension from the fan periphery. Each of the first and second scroll elements are linear. The scroll arrangement also provides the support for the basic structural parts of the ventilator.

23 Claims, 2 Drawing Sheets

VENTILATOR SCROLL ARRANGEMENT

BACKGROUND OF THE INVENTION

This invention relates to air diffusers wherein an air impeller, such as a fan, discharges air through a housing, airflow control apparatus, or the like associated with the fan. The discharge can be either into a confined space such as a room or into the atmosphere.

This invention will be discussed in connection with a building rooftop ventilator which uses a centrifugal fan to draw air from a building interior and discharges that air into the ambient atmosphere. It is to be appreciated, that the invention is not necessarily limited to that type of application.

Generally, such rooftop units are mounted on a curb which is attached to the roof and communicates with the building air delivery system. Specifically, the unit exhausts air from the building to the atmosphere. The centrifugal fan used as the air impeller and its associated drive elements are covered by a shroud, or other type of housing, for protection against the weather. An air discharge opening is provided in the protective housing. Exhaust air from the building travels through the interior of protective housing and out the discharge opening to the atmosphere.

In the past, such building air exhaust systems have been, for the most part, what may be referred to as a bulk transfer of air. That is, they have merely provided a forced withdrawal of air from the building interior and a more or less random discharge through the protective structure with little, if any, thought being given to aerodynamic properties. The problems and/or shortcomings of such prior systems have been relatively ineffective and inefficient transfer of air from the building interior to the atmosphere, and noise generation. Ineffective and inefficient air transfer impacts in a negative manner on the building air exhaust system. This, in turn, can impact negatively on the overall building air delivery system. It can also create a noise problem, of particular concern where the building is in a heavily populated urban area; although even in an isolated building noise can be a problem with respect to the building occupants and any operations carried on in the building.

It has been noted in such prior systems that part of the kinetic energy imparted to the exhaust air by the air impeller, and which could best be utilized in enhancing exhaust airflow, has been lost due to the random uncontrolled airflow within the rooftop unit.

SUMMARY OF THE INVENTION

Among the general objects of this invention, is to provide an efficient air discharge system. A more specific object in that regard is to provide an air discharge system wherein for a given size fan motor an increased volume of air can be discharged or, for a given volume of air, a smaller horsepower rated motor can be used.

Also among the general objects of this invention, is to provide an air exhaust system which reduces the amount of generated noise.

Of course, these Performance and noise comparisons are in reference to prior air exhaust systems.

Another object of this invention is to simplify the exhaust system structure while achieving the above-mentioned objectives.

A further general object of this invention is to make effective use of the kinetic energy imparted to the exhaust air by the exhaust fan.

In ventilators of the type to which this invention relates an air impeller, e.g., a centrifugal fan, draws air from the building interior as part of the overall air delivery system. That air is discharged from the periphery of the centrifugal fan, the fan imparting sufficient velocity to the air for it to pass through the interior of the ventilator housing and out to the atmosphere. For the achievement of the above objects, this invention, in a broad sense, contemplates controlling the flow of air from the centrifugal fan to discharge to the atmosphere.

More specifically, air leaving the tips of the centrifugal fan blades has, with reference to the axis of rotation of the fan, both a radial and a tangential component. From the standpoint of effective and efficient air discharge it has been observed that, whereas the tangential component provides a desirable airflow influence, the radial component can be a negative component. The radial component tends to cause turbulence at the air exit point from the fan blades and increases back pressure, particularly where the fan is enclosed in a shroud or other protective housing. The increased back pressure retards airflow and ultimate discharge to the atmosphere and places a larger load on the fan motor. The turbulence and back pressure also contribute to increased noise generation.

This invention proposes to confine the air leaving the fan and to influence that flow and the expansion of that air in a manner which reduces the radial components and produces a corresponding increase in the tangential component. This reduces turbulence at the blade tips and within the shroud, and lowers the pressure around the periphery of the fan, and thereby results in more effective air discharge with increased efficiency in fan motor operation and reduced noise. That is, a smaller motor can be used to move the same volume of air or a given size motor will move a larger volume of air.

More specifically and in the preferred embodiment, a scroll assembly is provided between the centrifugal fan and the discharge opening, or openings, defined in and at the shroud. The scroll is made up of a plurality of elements which extend generally from the fan periphery toward the shroud discharge opening. Those elements all have the same general configuration. Each element has a first generally linear segment which is located adjacent the fan blade tips where it receives air being discharged from the fan. The first linear segment projects, relative to the circumference and a radius of the fan, at least at a tangent or at an angle beyond the tangent. Each also includes a second generally linear segment which extends from a location remote from the fan periphery toward the first linear segment and at an angle to the first linear segment. The first and second linear segments are joined to form a continuous member extending from adjacent the fan blade periphery toward the discharge opening in the shroud. Preferably, the two segments are formed in one piece and meet at an obtuse angle, approximately 140°. The plurality of elements of the scroll are equally spaced around the periphery of the fan capturing and directing all of the air being discharged from the fan. The second linear segment of one element forms a discharge opening with the first linear segment of the next adjacent element and through which air passes to the shroud discharge opening.

With this scroll configuration, as mentioned generally above, the otherwise radial component of the air leaving the fan is redirected in a more tangential direction thereby imparting an increased tangential influence to the air being discharged. By utilizing linear segments in the scroll elements, larger discharge openings are defined. Both the increased tangential influence and the large discharge openings reduce turbulence with a resultant decrease in back pressure to give the above-mentioned desirable results. In essence, the scroll, configured as described above, recaptures some of the kinetic energy which would otherwise have been lost in the undesirable radial component and converts it into usable kinetic energy in a tangential sense.

This invention also proposes, in its preferred form, to utilize the scroll to simplify the exhaust system by having the scroll provide the basic support for the stationary elements of the system.

Other objects and advantages will be pointed out in, or be apparent from, the specification and claims, as will obvious modifications of the embodiment shown in the drawings.

DESCRIPTION OF THE PREFERRED EMBODIMENT

Figure 1:
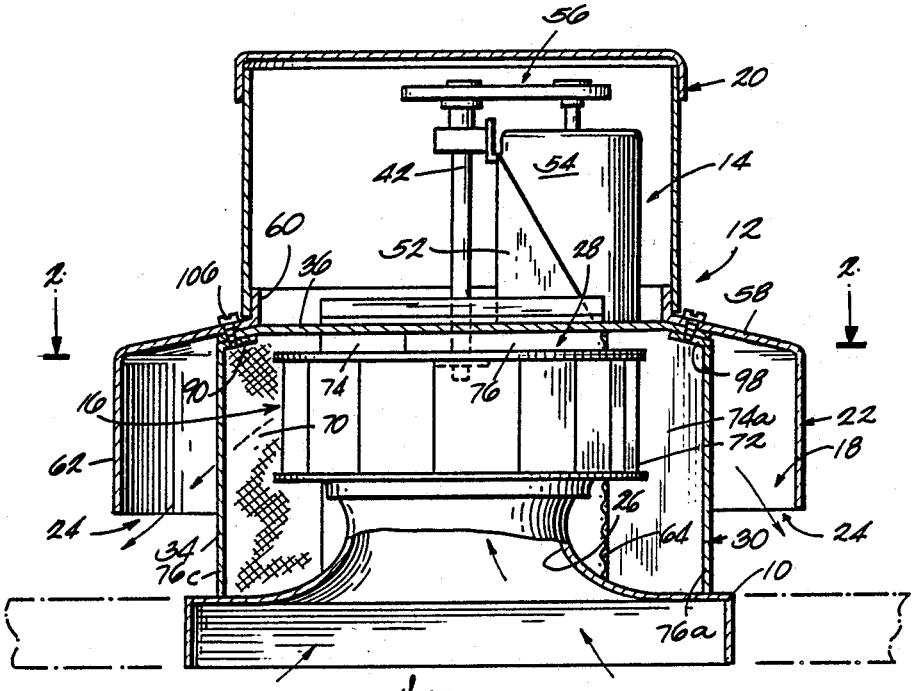
FIG. 1 is a side view, partially schematic, of an installation embodying this invention and with parts broken away to illustrate some of the interior components.

The rooftop ventilator embodying this invention, and referring to FIG. 1, consists of the general components, a rooftop curb 10, an outer housing 12, a drive mechanism 14 connected to a centrifugal fan 16 and scroll assembly 18. The curb 10 is connected to the rooftop of a building (not shown) and is attached thereto in a conventional manner (also not shown). The outer housing 12 is made up of two primary sections, a motor and mechanical component cover 20 and a shroud 22. The shroud 22 extends over a portion of the axial length of the scroll 18 and terminates in spaced relation from the scroll, and the curb, and thereby defines an generally annular discharge opening 24 extending around the periphery of the shroud assembly 18.

In operation, a centrifugal fan draws air from the building interior up through the curb 10. That air is then discharged radially from the centrifugal fan through the shroud 18 and is expelled to the atmosphere through the discharge opening 24. The path of airflow is illustrated by the arrows in FIG. 1.

Figure 3:
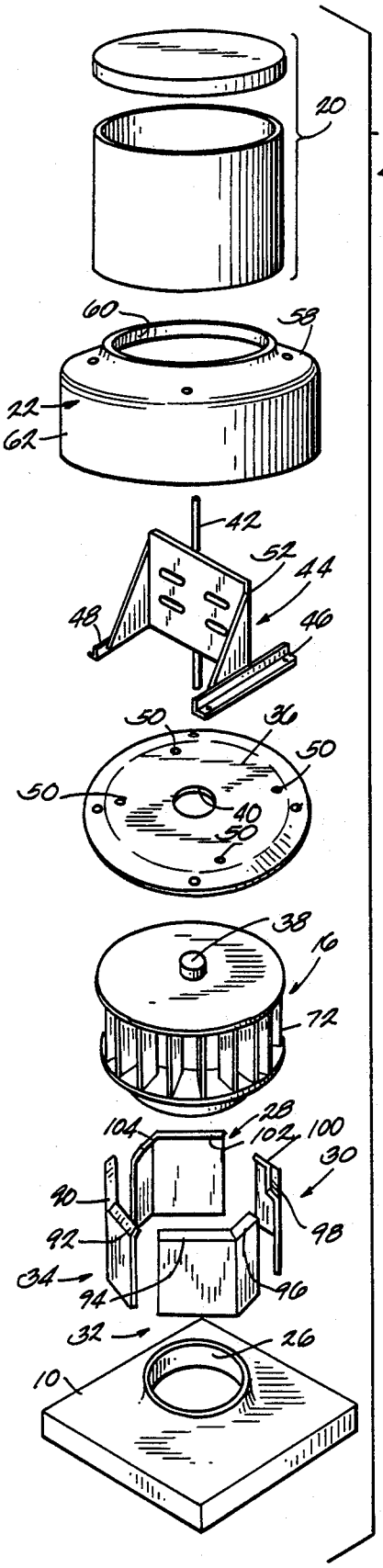
FIG. 3 is an exploded view of the basic components of the unit.

Specific reference will now be made to FIG. 3 for a more detailed structural description of the unit components and their arrangement.

The curb 10 includes a conventional venturi section 26 through which air is drawn. The scroll assembly 18 rests on the upper surface of curb 10 and is made up of four identically configured elements 28, 30, 32, and 34.

The centrifugal fan 16 fits within the scroll assembly and over the curb venturi 26.

A mounting plate 36 fits over the top of the centrifugal fan 16 and is attached to the individual elements 28–34 of the scroll assembly in a manner to be discussed more specifically hereinafter. A stubshaft 38 of the centrifugal fan extends through a central opening 40 in the mounting plate and is attached to a power shaft 42 which is part of a motor drive and mount assembly 44 attached to the upper side of mounting plate 36. More specifically, the motor mount of assembly 44 consists of two angle brackets 46 and 48, which are attached by screws (not shown) extending into openings 50 in mounting plate 36. Angle brackets 46 and 48 are in turn attached to a motor mount 52 which supports a drive motor 54 shown only in FIG. 1. Drive shaft 42 attaches to stubshaft 38 and through a transmission arrangement 56 illustrated schematically in FIG. 1, the motor 54 (shown only in FIG. 1) that, when energized, rotates centrifugal fan 16.

The shroud 22 has a generally horizontal shoulder portion 58 which terminates in a circular opening 60. A skirt 62 extends downwardly from the shoulder portion 58 and is the portion of the shroud which overlaps a part of the vertical extension of the scroll assembly 18. The motor 44 and drive and mount assembly 54 project upwardly through opening 60 and are enclosed in the upper housing portion 20.

With this arrangement, all of the components are operationally and structurally interconnected to provide a compact operating unit. The drive elements and the fan are protected from the weather by the housing parts 20 and shroud 22.

To prevent entry of birds and large insects, screening 64, 66, 68, and 70 is provided between adjacent scroll elements 28, 30, 32, and 34, respectively. The screening elements, for convenience, have only been illustrated in FIG. 1.

Figure 2:
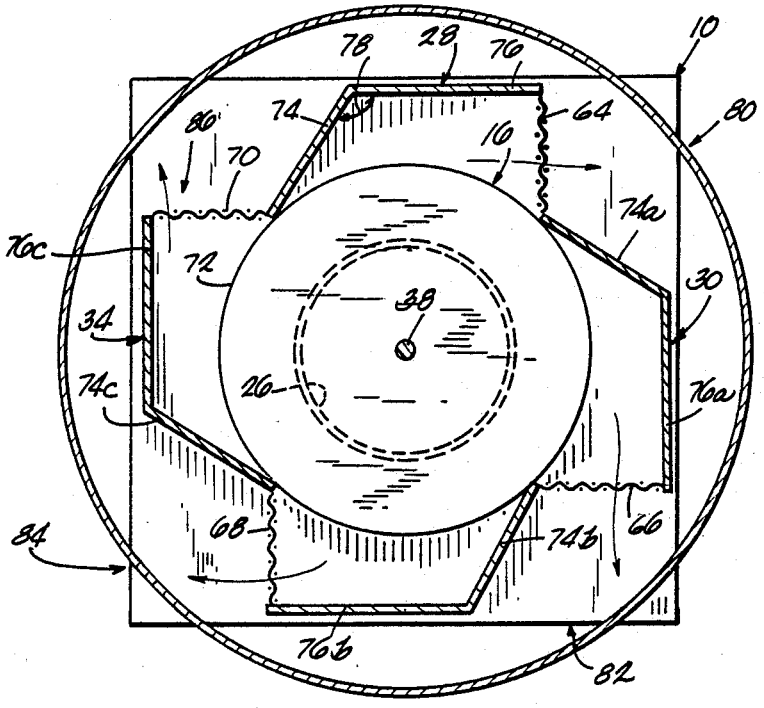
FIG. 2 is a section taken generally along lines 2—2 of FIG. 1.

Turning now to FIG. 2, the configuration of the elements making up the scroll will be described as will be the operation and advantages resulting therefrom.

Each of the scroll elements 28, 30, 32, and 34 have an identical configuration and, therefore, only one, 28, will be described in detail. Similar structural elements will be identified in a relative manner for the other scroll elements, that is, designations a, b, and c will be used for scroll elements 30, 32, and 34, respectively.

Scroll element 28 includes a first linear segment 74. The linear segment 74 extends from a location adjacent the periphery 72 of the centrifugal fan. A second linear segment 76 projects from an area remote from the periphery of the fan 72 back toward the first segment 74. That remote area is in the vicinity of the discharge opening 24 so that the scroll elements terminate adjacent that discharge opening. Segments 74 and 76 are suitably joined. In the preferred embodiment, the two segments are a one-piece structure meeting at a sharp angle 78.

Linear segment 74 is arranged relative to the circumference and a radius of the centrifugal fan 16 such that it projects at least at a tangent. More specifically, as illustrated, segment 74 is arranged as a tangent to the periphery of the centrifugal fan 16. It will be appreciated that the periphery of the centrifugal fan 16 also defines the path of rotation of the fan blade tips. The tangential relationship can be varied but it should not be less than a tangent and should either be at an angle which establishes a tangent or beyond. This provides for efficient and effective receipt, by the scroll element 28, of the air being discharged from the centrifugal fan and transmission of that air outwardly from the centrifugal fan toward the shroud discharge openings 24.

The scroll elements are equally spaced around the periphery of the centrifugal fan. This provides four equally spaced discharge openings 80, 82, 84, and 86. It will be noted that the discharge openings are provided between the segments 76, 76*a*, 76*b*, and 76*c*, and the segments 74*a*, 74*b*, 74*c*, and 74, respectively. By having linear extensions at the terminal ends of both of the segments 74 through 74*c* and 76 through 76*c*, the size of the discharge openings formed are large and therefore effectively accommodate the airflow through and out of the scroll assembly.

As was noted generally above, as the air is expelled from the centrifugal fan 16, it has both a radial and a tangential component as it leaves the fan blade tips and relative to the fan circumference on the periphery 72. Linear segments 74, 74*a*, 74*b*, and 74*c* interrupt the flow of the radial component of that air discharge and smoothly and effectively redirect it in a tangential manner. By doing so, the overall tangential component of the air being discharged from the centrifugal fan is increased, thereby more effectively moving more air away from the impeller and through the unit. The relatively larger discharge openings 80, 82, 84 and 86 accommodate this volume of air, the combination of the linear segments 74, 74*a*, 74*b*, 74*c* and the large discharge opening defined in the shroud thereby cooperating in this effective air discharge. More specifically, the radial and tangential components of the air being discharged from the centrifugal fan represents kinetic energy; but the kinetic energy of the radial component, unless controlled, will be lost in turbulence and resultant back pressure. With the arrangement of this invention, that otherwise lost kinetic energy is recaptured and redirected in an effective manner to contribute to an enhanced discharge through the rooftop unit.

For operational purposes, and for structural purposes as will be defined hereinafter, linear segment 76 and 74 meet at an angle 78. Preferably, that angle is approximately 140°. The joining of the linear segments 74 and 76 at an angle has two advantages, one as described above in the enhanced airflow properties. The other is that it simplifies the fabricating procedures. The scroll elements 28, 30, 32, and 34 can then be made as a one-piece structure, preferably sheet metal. The sheet metal can be effectively and simply formed in a break press to provide the angle 78. This is a relatively simple fabricating procedure.

Figure 1A:
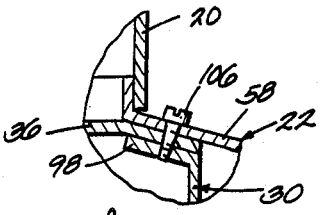
FIG. 1*a* is an exploded view of a portion of FIG. 1.

By utilizing the above linear constructions, it is also possible to provide the scroll elements 28, 30, 32 and 34 with flanges 90, 92, 94, 96, 98, 100, 102, 104. Similar flanges can be provided on the lower ends of the scroll elements, but are not shown. These flanges can be produced in a simple bending operation and then provide a means of attachment of the scroll element to the curb and also to mounting plate 36. The flanges are connected to that mounting plate through use of a plurality of machine screws 106, only one of which is illustrated in FIG. 1*a*. The scroll assembly then provides the basic structural support, or the basic structural connection, for all of the elements of the rooftop unit to the curb, achieving a simplification in the overall structure of the ventilator unit.

Figure 4:
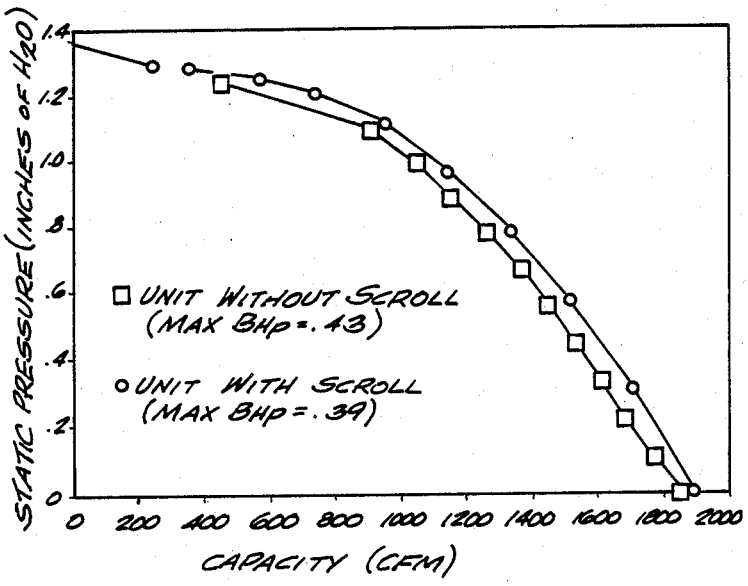
FIG. 4 is a graph illustrating the improved performance of a typical installation utilizing this invention.

A rooftop unit with the scroll arrangement of this invention improves the overall air exhaust performance of the rooftop unit. That is, for a given volume of air a smaller fan motor can be utilized, or for a given size motor a larger volume of air will be exhausted. The chart of FIG. 4 illustrates this improved performance. FIG. 4 charts the performance "Capacity" vs. static pressure inches of water for two different motors, one, with the scroll and one without the scroll. The unit without the scroll utilized a fan motor which measured a maximum brake horsepower of 0.43 whereas the unit with the scroll utilized a fan motor which measured a maximum brake horsepower of 0.39. As can be seen from the chart, with the scroll and the smaller motor, the overall performance of the unit was shifted up and to the right thereby illustrating an overall improvement in the unit operation. The performance charted in FIG. 4 is typical of various fan or impeller sizes.

Although this invention has been illustrated and described in connection with a particular embodiment thereof, it will be apparent to those skilled in the art that various changes and modifications may be made therein without departing from the spirit of the invention or from the scope of the appended claims.

What we claim is:

1. A rooftop ventilator comprising, in combination, fan means arranged for rotation about a generally vertical axis, curb means having an inner opening associated with said fan means and through which air is drawn to said fan means when said fan means is energized, outer housing means extending from above and providing an outer enclosure for said fan means, said outer housing terminating above and spaced from said curb means to define therewith a discharge opening for air drawn from said curb means and discharged by said fan means toward said outer housing, scroll means above said curb means ad arranged around the periphery of said fan means for receiving air discharged by said fan means and directing said air toward said discharge opening, said scroll means comprising a plurality of scroll elements equally spaced around the periphery of said fan means, each of said scroll elements comprising a first elongated element having one end generally adjacent said fan periphery and extending away from said fan periphery, a second elongated element, means connecting said first and second elements in a generally continuous extension from said one end of said first elongated element through said second element to the end of said second element remote from said one first element end, and said second element characterized in that a length thereof remote from said fan periphery is generally linear and said linear length is disposed generally at an angle to said first elongated element, and said linear length of each of said second scroll elements defining an air discharge opening with an adjacent scroll element so that said scroll elements extend from said fan periphery in a non-linear configuration and the scroll elements and the defined discharge openings effectively direct the air discharge from said fan means without substantial loss of kinetic energy.

2. The rooftop ventilator of claim 1 wherein said first element is characterised, in that a length thereof adjacent said fan periphery is linear.

3. The rooftop ventilator of claim 2 wherein said first and second elongated elements are linear along their entire length.

4. The rooftop ventilator of claim 3 wherein said first elongated element extends relative to the periphery of said fan means at least at a tangent.

5. The rooftop ventilator of claim 3 wherein the angle at which said first and second elongated elements meet is an obtuse angle.

6. The rooftop ventilator of claim 3 including means connecting said fan means and said fan means to said housing to form a unitary assembly, and means connecting said first and second elongated elements to said unitary assembly so that said scroll means provides a basic connecting media for said unitary assembly.

7. The rooftop ventilator of claim 3 including four scroll elements equally spaced around the periphery of said fan means.

8. The rooftop ventilator of claim 6 including four scroll elements equally spaced around the periphery of said fan means and wherein said means connecting said elongated elements to said unitary assembly comprise flanges projecting angularly from at least one of said elongated elements.

9. The rooftop ventilator of claim 5 wherein said angle at which said first and second elongated elements meet is approximately 140°.

10. The rooftop ventilator of claim 1 wherein said fan means includes an air impeller and a drive motor, said drive motor being positioned above said air impeller, and including mounting plate means for supporting said drive motor, and wherein said scroll means is connected to said mounting plate means and said curb means for providing the support connection of mounting plate on said curb means.

11. The rooftop ventilator of claim. 10 including means connecting said outer housing to said mounting plate means.

12. The rooftop ventilator of claim 11 wherein said first and second elongated elements are linear along their entire length and meet at an angle and wherein said elongated elements are attached to said mounting plate means.

13. The rooftop ventilator of claim 12 including four scroll elements equally spaced around the periphery of said fan means and wherein said means connecting said elongated elements to said unitary assembly comprise flanges projecting angularly from at least one of said elongated elements and attached to said mounting plate means.

14. The rooftop ventilator of claim 10 including four scroll elements equally spaced around the periphery of said fan means and wherein said means connecting said elongated elements to said unitary assembly comprise flanges projecting angularly from at least one of said elongated elements and attached to said mounting plate means.

15. An air system comprising, in combination, means defining a housing having an interior space and an outer wall cooperating in the definition of said interior space, air impeller means within said housing including fan means and means supporting said fan means for rotation about an axis, said fan means operative upon rotation to discharge air from the periphery thereof into the interior space of said housing and toward said outer wall, scroll means arranged at the periphery of said fan means and extending from said fan means toward said outer wall for directing air discharged from said fan means through said interior space toward said outer wall, said scroll means comprising a plurality of scroll elements spaced around the periphery of said fan means and each of said scroll elements comprising a first elongated element having one end generally adjacent said fan periphery and extending away from said fan periphery, a second elongated element, means connecting said first and second elements in a generally continuous extension from said one end of said first element through said second element to an end of said second element remote from said one first element end, and said second element characterized in that a length thereof adjacent said second element end is generally linear and said linear length is disposed generally at an angle to said first elongated element, and said linear length of each of said scroll elements defines an air discharge opening with an adjacent scroll element so that said scroll elements extend from said fan periphery in a non-linear configuration and the scroll elements and the defined discharge openings effectively direct the air discharge from said fan means without substantial loss of kinetic energy.

16. The air system of claim 15 wherein said first element is characterized in that a length thereof adjacent said fan periphery is linear.

17. The air system of claim 15 wherein said first and second elongated elements are linear along their entire length and meet at an angle.

18. The air system of claim 17 wherein said first elongated element extends relative to the periphery of said fan means at least at a tangent.

19. The air system of claim 18 wherein the angle at which said first and second elongated elements meet is an obtuse angle.

20. The air system of claim 17 including means connecting said air impeller means and said fan means to said housing to form a unitary assembly, and means connecting said first and second elongated elements to said unitary assembly so that said scroll means provides a basic connecting media for said unitary assembly.

21. The air system of claim 17 including four scroll elements equally spaced around the periphery of said fan means.

22. The air system of claim 20 including four scroll elements equally spaced around the periphery of said fan means and wherein said means connecting said elongated elements to said unitary assembly comprise flanges projecting angularly from at least one of said elongated elements of said scroll elements.

23. The air system of claim 19 wherein said angle at which said first and second elongated elements meet is approximately 140°.

* * * * *